United States Patent [19]

Volpe, Jr.

[11] 4,174,048

[45] Nov. 13, 1979

[54] TABLET RETAINING AND DISPENSING DEVICE

[76] Inventor: John J. Volpe, Jr., 52 Taft St., Milford, Mass. 01757

[21] Appl. No.: 839,393

[22] Filed: Oct. 4, 1977

[51] Int. Cl.[2] ..... B65D 83/04

[52] U.S. Cl. ..... 221/267; 206/537; 221/279

[58] Field of Search ..... 221/279, 280, 198, 310, 221/267; 312/61, 71; 206/537, 536, 535; 220/93; 133/1 A, 5 A-5 B, 8 R-8 E, 6

[56] References Cited

U.S. PATENT DOCUMENTS

| | | | |
|---|---|---|---|
| 565,903 | 8/1896 | Jones | 133/6 |
| 2,285,180 | 6/1942 | Weinberg | 220/93 |
| 2,294,001 | 8/1942 | Ritter | 221/310 X |
| 3,228,556 | 1/1966 | Nonestied | 221/279 |
| 3,365,099 | 1/1968 | Mctaggart | 206/535 X |

*Primary Examiner*—Francis J. Bartuska
*Attorney, Agent, or Firm*—Clarence L. Carlson

[57] ABSTRACT

A tablet retaining and dispensing device of generally cylindrical configuration having a disposable tablet containing cartridge removably attached to one of its ends and an ejector rod mounted within the dispenser that is selectively movable so as to eject not more than a single tablet with each selective movement of the rod. A sanitary cap is removably attached to the tablet ejecting end of the cartridge and includes an integrally formed clip member which serves to retain the dispenser in the pocket of an article of clothing.

2 Claims, 5 Drawing Figures

TABLET RETAINING AND DISPENSING DEVICE

BACKGROUND OF THE INVENTION

The present invention pertains to a tablet retaining and dispensing device (hereinafter referred to as dispenser) which is adapted to be retained in the pocket of an article of clothing and more particularly it relates to an improved dispenser for medicinal tablets which are confined within a disposable cartridge that is removably attached to one end of the dispenser. The dispenser includes a tablet ejecting device that is manually actuated in a manner whereby accidental discharge of a tablet is prevented, only a single tablet can be ejected with each actuation of the ejecting device and by either the sense of sight or feel with the portion of the ejecting device operatively associated with the exterior surface of the dispenser one can quickly check to determine the number of available tablets remaining therein.

A number of United States patents show and describe forms of pill or tablet dispensers which resemble pen-like implements and for reference to the teachings of such disclosures attention is hereby drawn to U.S. Pat. Nos. 2,294,001 and 2,885,110.

SUMMARY OF THE INVENTION

The tablet dispenser according to the present invention includes a cylindrical member with a disposable tablet containing cartridge removably attached to one end thereof. An ejector rod is located within the cylindrical member in a manner whereby one of its ends is in contact with a tablet in the cartridge. The cylindrical member is provided with a channel extending along a portion of its length which has a configuration defining a uniform square sine path. By means of a selector pin fixed to the ejector rod and extending outwardly therefrom through and beyond the limits of the channel, said ejector rod can be selectively actuated so that not more than a single tablet will be ejected with each actuation thereof. The configuration of the channel is such that the initial selective movement of the selector pin rotates the same within the cylindrical member to a position whereby it can be moved longitudinally therein a limited distance sufficient only for the ejection of a single tablet from the cartridge.

It is a general object of the invention to provide a dispenser for medicinal tablets having a disposable tablet containing cartridge removably attached thereto and from which accidental discharge of a tablet is prevented.

A further object is to provide a tablet dispenser that is quickly and easily attached and detached from the pocket of an article of clothing of the user of the tablets contained therein.

A still further object is to provide a tablet dispenser having a tablet ejecting device which by the sense of sight or feel one can quickly check to determine the number of available tablets remaining therein.

These and other objects of the invention will become more fully apparent by reference to the appended claims and as the following detailed description proceeds in reference to the figures of drawing wherein:

DESCRIPTION OF THE PREFERRED EMBODIMENT

Figure 1:
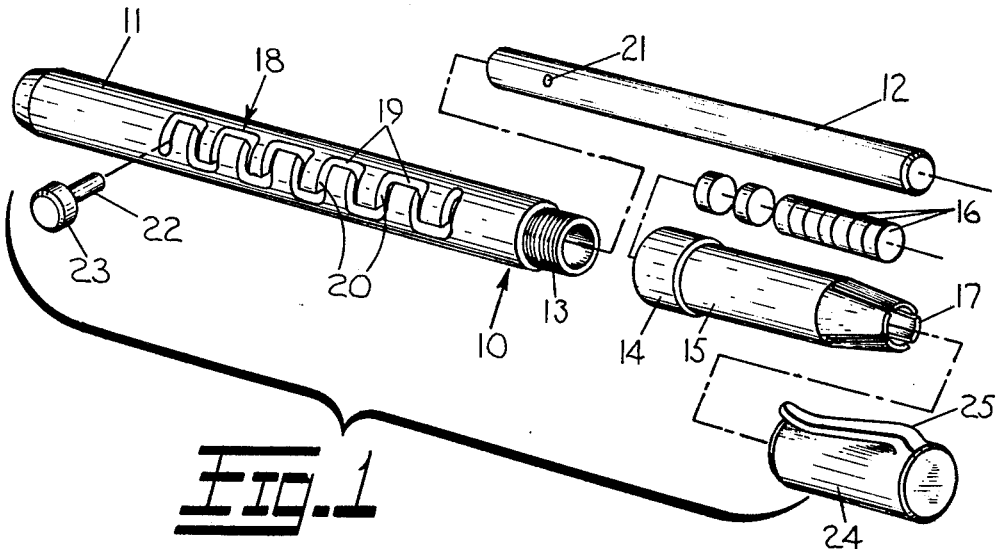
FIG. 1 is a perspective view in exploded form showing the various elements comprising the tablet dispenser according to the invention.

Referring now to the FIGS. of drawing the tablet dispenser according to the invention is identified generally by numeral 10 and includes among its various parts a cylindrical member 11 within which an ejector rod 12 is assembled for limited rotational and longitudinal movement by a means to be more fully described hereinafter.

One end of the cylindrical member 11 is of reduced diameter which is threaded as at 13 (FIG. 1) and has assembled thereon the internally threaded end 14 of a disposable cartridge 15. A plurality of tablets 16 are contained within the cartridge 15 and that end of the latter opposite the threaded end 14 is formed to define a flexible finger type collet retainer 17. This form of retainer serves to prevent accidental discharge of a tablet from the dispenser and yet the fingers thereof are sufficiently flexible so that a single tablet can be ejected from said dispenser with each actuation of the ejector rod now to be described.

Figure 4:
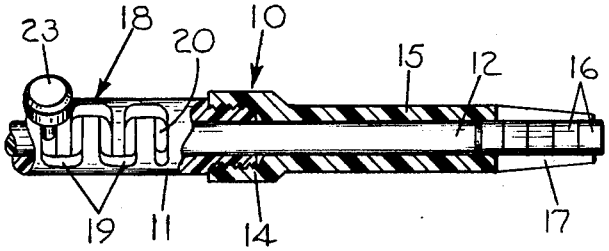
FIG. 4 is an elevational view and partially in section showing the location of the selector pin prior to actuation of the ejector rod.
Figure 5:
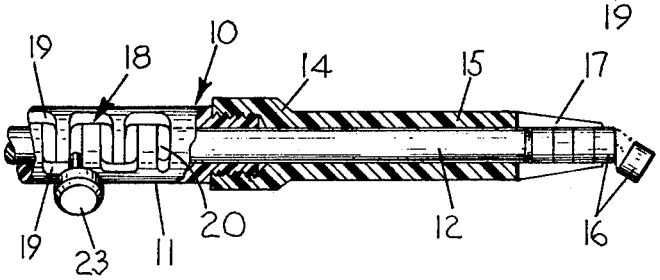
FIG. 5 is a view similar to that of FIG. 4 but showing the selector pin having been moved so as to effect the ejection of a single tablet from the tablet containing cartridge.

As more clearly shown in FIGS. 1, 4 and 5 the cylindrical member 11 includes a channel generally indicated by numeral 18 which communicates with both the inner and outer surfaces thereof. This channel 18 is disposed intermediate the ends of the cylindrical member 11 and has a configuration which defines a uniform square sine path extending for a substantial portion of the length of said cylindrical member. Those portions of the channel 18 that extend parallel with the axis of the cylindrical member are identified by numeral 19 and those which interconnect the ends of the latter are depicted by numeral 20.

Figure 3:
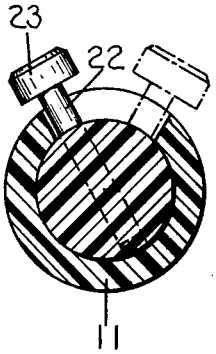
FIG. 3 is an end view of the dispenser showing by means of full and phantom lines the distance the selector pin can be moved to rotate the ejector rod to a position to permit limited longitudinal movement thereof.

The ejector rod 12 as shown in FIG. 1 is provided with an aperture 21 which traverses the axis of said ejector rod and is located adjacent that end opposite that which is adapted to engage the tablets within the cartridge 15. A selector pin 22 is fixedly assembled within the aperture 21 by any suitable means, such as a press fit, and in assembled position within the cylindrical member 11 said pin extends outwardly through and beyond the channel 18. That portion of the pin 22 which protrudes through and beyond the channel 18 terminates in a thumb engaging button 23 which permits a single tablet 16 to be ejected by first moving said button from the phantom to full line position shown in FIG. 3. This movement of the pin within that portion of the channel identified by numeral 20 rotates the ejector rod a sufficient distance so as to align said pin with that portion of the channel depicted by numeral 19. In this position the button 23 is pushed so as to cause pin 22 to move the entire length of that portion 19 of the channel which simultaneously causes longitudinal movement of the ejector rod 12 within the cylindrical member 11 and cartridge 15 a distance sufficient only to effect the ejection of a single tablet from said cartridge.

It should be understood that the channel 18 can be formed to accommodate a variety of sizes of tablets so that each actuation of the ejector rod 12 will only permit the ejection of a single tablet.

Figure 2:
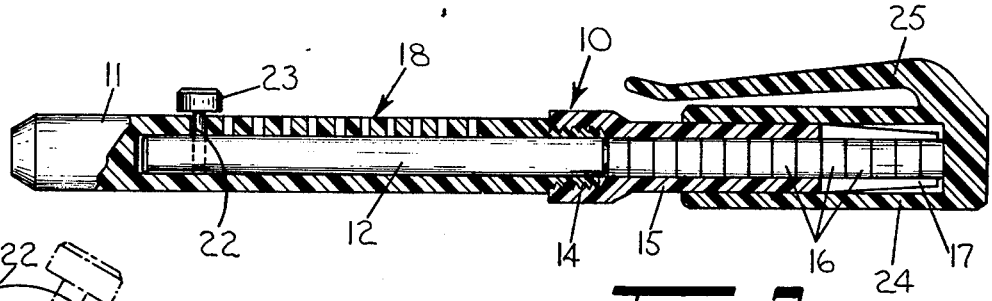
FIG. 2 is an assembled view in side elevation and partially in section of the dispenser in FIG. 1.

Referring to FIGS. 1 and 2 a sanitary cap 24 is adapted to assemble by means of a press fit over that end of cartridge 15 from which the tablets 16 are ejected. This cap also includes an integrally formed pocket attaching clip 25 which extends in a direction substantially parallel with the axis of the dispenser and serves as a convenient means for retaining said dispenser in the pocket of an article of clothing.

To summarize the invention, the user of the tablets contained within the dispenser simply has to remove the sanitary cap and then rotate the ejector rod by means of the button 23 so that the selector pin will move within the limits of one of the portions of the channel identified by numeral 20. The button is then pushed in a longitudinal direction relative to the dispenser which simultaneously moves the pin 22 within that portion of the channel identified by numeral 19 and the ejector rod 12 within the cylindrical member a distance which effects the ejection of a single tablet from the cartridge. The procedure described must be repeated for each additional tablet required. Upon depletion of the tablets within the cartridge, the latter is simply disassembled from the cylindrical member and discarded. The ejector rod must then be returned to its starting position within the cylindrical member which permits another disposable cartridge, having a full compliment of tablets, to be assembled on the threaded end of said cylindrical member.

Although the present invention has been described in connection with a preferred embodiment, it is to be understood that modifications and variations may be resorted to without departing from the spirit and scope of the invention as those skilled in the art will readily understand. Such modifications and variations are considered to be within the perview and scope of the invention and the appended claims.

I claim:

1. A tablet retaining and dispensing device comprising:

(a) a cylindrical member;

(b) a tablet containing cartridge removably attached to one end of said cylindrical member;

(c) an ejector rod assembled within said cylindrical member for engaging a tablet within said cartridge; and (d) means operatively associated with said ejector rod which allows limited rotation of said ejector rod within said cylindrical member between positions which restrict longitudinal movement of said ejector rod within said cylindrical member and positions which allow limited longitudinal movement of said ejector rod within said cylindrical member a distance to cause the ejection of a single tablet from said cartridge, which includes:

(i) opposed side walls forming a channel communicating with the inner and outer surfaces of said cylindrical member having a configuration extending for a portion of the length of the latter defining a uniform square sine path; and (ii) a selector pin fixedly attached to said ejector rod and extending in a direction normal to the axis of the latter outwardly through and beyond said channel.

2. The tablet retaining and dispensing device according to claim 1 wherein said selector pin terminates at its outer end in a thumb engaging button for effecting manual movement of said ejector rod in accordance with the configuration of said channel.

* * * * *